United States Patent [19]

Turro et al.

[11] 4,437,265

[45] Mar. 20, 1984

[54] SAFETY GUARD

[76] Inventors: Jerome Turro, 254 Spencer Pl., Riverdale, N.Y. 10471; Peter Nelson, 2825 Schurz Ave., Bronx, N.Y. 10465

[21] Appl. No.: 353,283

[22] Filed: Mar. 1, 1982

[51] Int. Cl.[3] ..... E06B 3/68

[52] U.S. Cl. ..... 49/57; 292/305

[58] Field of Search ..... 49/56, 57; 292/305

[56] References Cited

U.S. PATENT DOCUMENTS

| | | | |
|---|---|---|---|
| 999,682 | 8/1911 | Suits | 49/57 |
| 1,018,427 | 2/1912 | Killingsworth | 292/305 |
| 1,662,167 | 3/1928 | Rexinger | 49/55 |
| 2,081,677 | 5/1937 | O'Neill | 292/305 |

*Primary Examiner*—Kenneth Downey

*Attorney, Agent, or Firm*—Paul J. Sutton

[57] ABSTRACT

The present invention provides a children's safety guard apparatus for installation into the frame of a window. A plurality of preferably square guard bars disposed in spaced relationship are connected to two support members, which are secured to the frame of a window. The bars are adjustable to a predetermined length, comprising two elongated members, one slidably mated inside the other. A means for locking the members so as to prevent them from sliding together is mounted to at least one bar of the plurality, the means being attached to the smaller member abutting the larger member. The means for locking includes a flexible sleeve portion surrounded by a flexible grip having flanges that can be drawn together or released via a bolt extending through bolt holes in the flanges, the bolt having a head provided with a keyway that fits a key.

1 Claim, 11 Drawing Figures

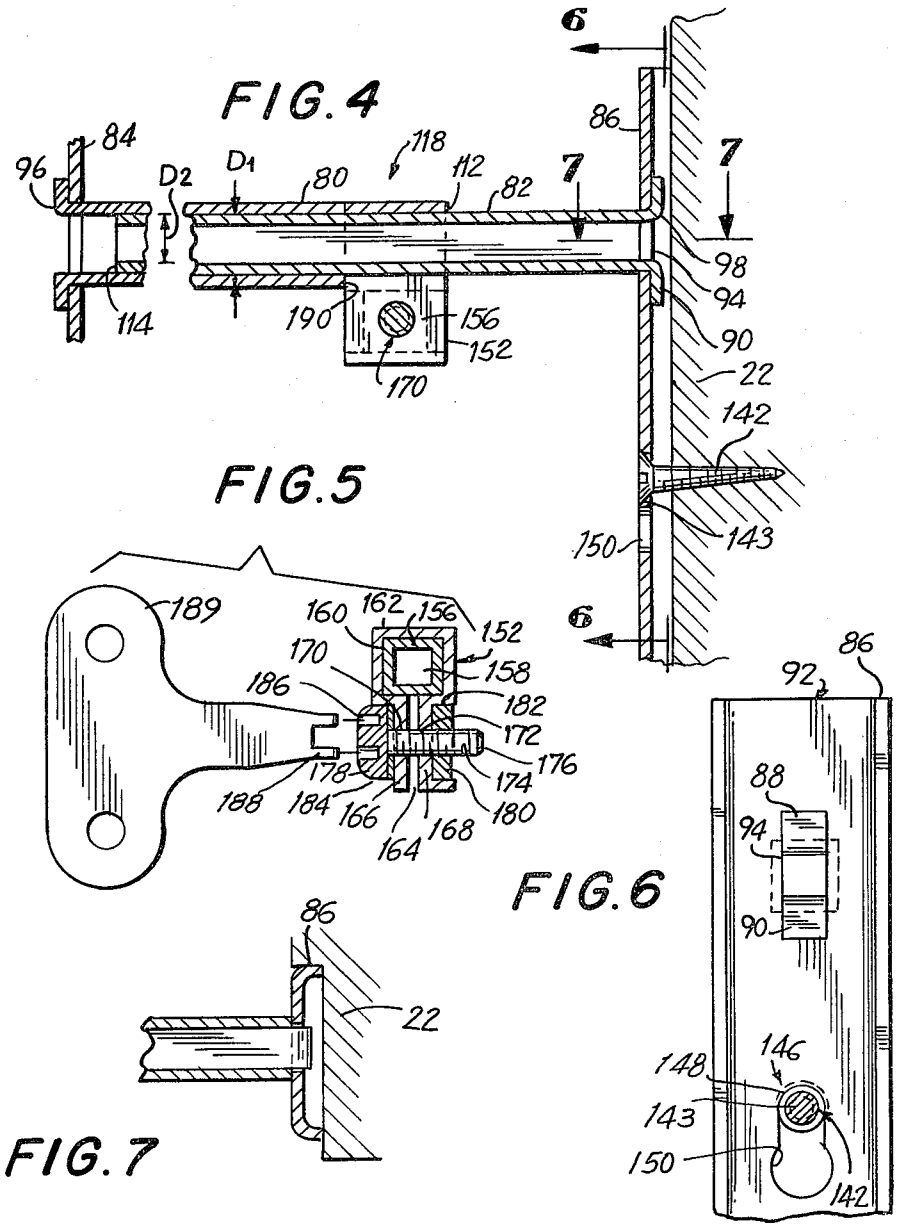
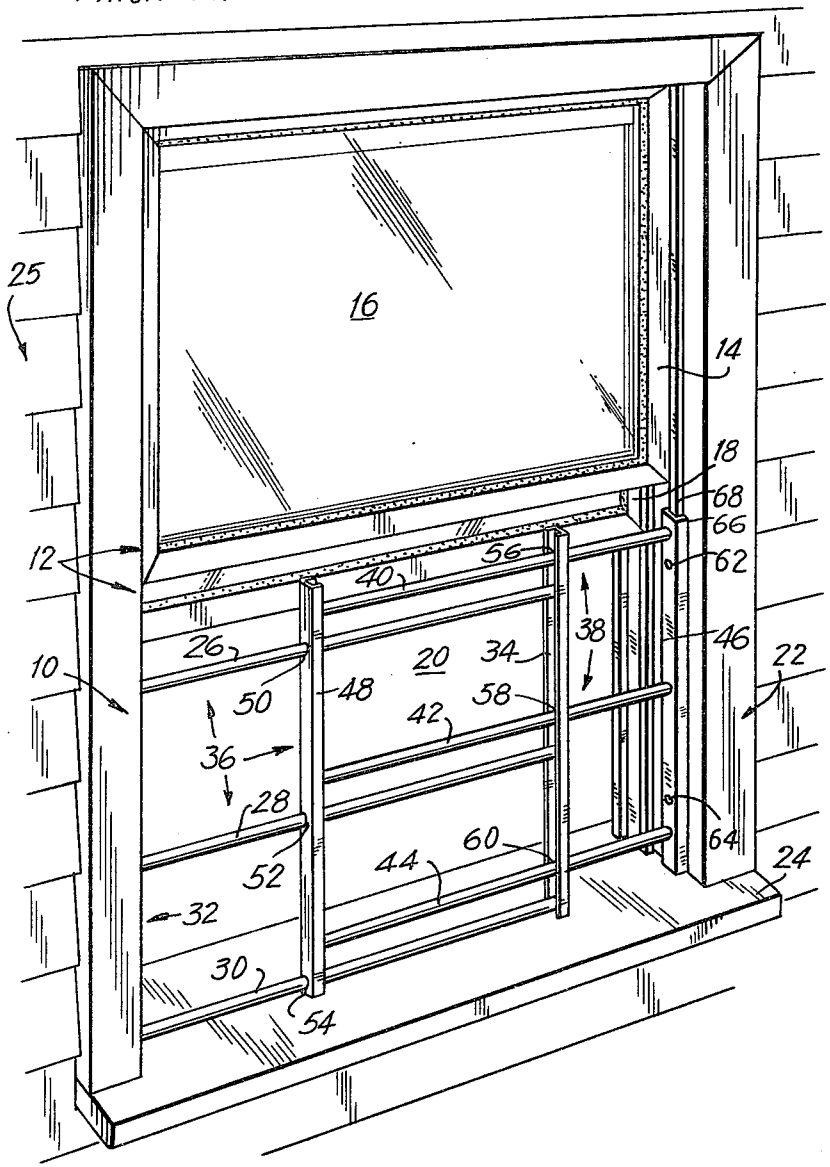
FIG. 1
PRIOR ART

SAFETY GUARD

The present invention relates generally to a safety guard apparatus and more particularly to an improved adjustable safety guard apparatus for children for installation into the frame of a window or door.

Increasing attention is being given to installing safety guards on windows and the like to which children have access, particularly in the large cities with apartments above one floor. The number of children being injured, maimed, or killed by falls from open windows or such apertures has been a problem for some time. A resistance to laws requiring installation of window safety devices has developed, however, in part because of problems associated with cost, general strength and reliabiliy, and ease of both installation and removal.

Efforts have been made to overcome these difficulties and are known to those familiar with the art. One of the leading manufacturers of window guards, prior art apparatus, features childrens safety guards for double hung windows and another for casement windows. These guards are illustrated and described in the company catalogue. One set of three tubular horizontal members welded to two stiles is slidably interconnected with a second set of three tubular horizontal members also welded to two stiles. Each set is screwed to opposite sides of the window frame after being mounted in the window and slid into connecting position. This construction is amplified upon below, where an illustration of this apparatus is further described with reference to prior art FIG. 1.

The above construction, while successful in performing certain desirable functions, such as adjustability to the width of a particular window, has several drawbacks. Briefly, these drawbacks are as follows. First, the apparatus is not easily removed since the frame screws holding the stiles to the frames must be unscrewed. Thus, easy placement and removal is, for practical purposes, eliminated. Yet, ease of removal and replacement is a desirable performance characteristic, since, for any number of reasons, such as varying use of particular rooms, the necessity of always having the guard installed can become a nuisance. Added to this is a reverse safety feature, such as easy access through the window, which is lacking when it must be unscrewed. To overcome this problem by providing the side stiles with screw head receiving holes with connecting screw slots for holding the stile to the frame allowing it to be sliding released by lifting the stile from the screw would not be practical, because, if once one set of horizontal members is lifted and released by accident, the entire apparatus will tend to slide, one portion into the other portion, and the entire apparatus becomes loose and hanging from the opposite stile screws. Thus, with a simple unintentional movement by a child, the entire apparatus becomes ready for collapse, possibly out of a multistory window. A second drawback of the Jaybil apparatus is that with the middle portion slidable in both directions, any pressure against the middle portion causes the horizontal members to move against the screws and a leverage of the screws from the frame occurs. This can of course tend to loosen the screws in the frame. A third drawback of the Jaybil apparatus, related to the above, is that it must be protected when mounted by fitting in channel stiles over the back track of double hung windows. Thus, the apparatus can only be placed on the outside of the window. This is further discussed below with reference to prior art FIG. 1. A fourth drawback of the Jaybil apparatus is that is must be used only in a horizontal mounting, that is, with the members, or bars, never oriented vertically. The reason for this is that, even if the top "side" stile were equipped at the top with side flanges for connecting to the window frame, the sheer weight of the top set of bars and stiles would cause an unchecked downward pull with only the flange screws holding up the entire apparatus. A fifth drawback of Jaybil is the aesthetic and the vision-blocking problems caused by the two middle vertical stiles.

Prior art apparatus also advertise an adjustable childrens safety guard for casement windows with adjustable horizontal tubular members inserted into smaller horizontal tubular members each welded to opposed side stiles that are screwed or clipped to the sides of the casement frame. Although this model has no vertical middle stiles because of the shortness of the span, the same general comments apply to this design as to the design discussed above.

Although the Jaybil Industry safety guards have certain advantages, the primary one being adjustability, they have the above discussed drawbacks. Added problems beyond the design problems discussed are those of the cost of manufacture, packaging, and shipping. That is to say, there is an obvious excess material factor for the horizontal members double over in the middle for no good safety reason, In addition, the two middle stiles likewise perform little useful function once the apparatus is installed, for their basic function is to provide adjustability to the apparatus. The extra stiles and unneeded horizontal member add material, weight, size, and complexity to the manufacturing and shipping process.

My invention contemplates the elimination of most or all of the limitations and disadvantages in the present state of the art noted above.

Accordingly, it is an object of my invention to provide an adjustable window guard with means for locking the guard bars into a predetermined position.

It is a further object of the present invention to provide a means for transferring longitudinal thrust so that the guard bars can be mounted in a vertical position.

It is a yet further object of the present invention to provide rigidity to the guard bars to prevent them from sliding together at their area of adjustability, thus preventing said bars from being shortened and aiding in maintaining the integrity of the fastening connections to the window frame and allowing placement of the apparatus inside as well as outside the window.

It is another object of my invention to provide rigidity to the bars via a locking device thus allowing the apparatus to be used in windows of all types in varied positions with the bars either horizontal or vertical.

It is yet a further object of this invention to provide a window safety apparatus that can be easily removed and replaced.

It is yet another object of my invention to provide a window safety apparatus that can be easily locked into position with a key and can be unlocked with a key and easily removed.

It is yet a further object of this invention to provide safety bars of rectangular configuration that act to prevent passage of a child between the bars.

It is yet a further object of my invention to provide a window safety apparatus that maintains a relatively clear field of vision.

It is still another object of my invention to provide a window safety apparatus having a plurality of single parallel bars that are adjustable and can be prevented from sliding together.

It is still another object of my safety apparatus to provide a novel means of reducing cost of materials, manufacturing, weight, and shipping.

FIG. 1 shows a perspective view of the prior art, namely, the Jaybil Industries Inc. childrens safety guard apparatus, mounted on the outside of a double hung window.

FIG. 4 illustrates a horizontal bar at the juncture of two members, a locking means and a portion of the support member taken along line 4—4 of FIG. 3.

FIG. 5 shows a side cross-section of the locking means of the present invention taken along line 5—5 of FIG. 3.

FIG 6 illustrates the present invention taken along line 6—6 of FIG 4.

FIG. 7 shows a detail of the connection of the bar to the support member taken along line 7—7 of FIG. 5.

Figure 3:
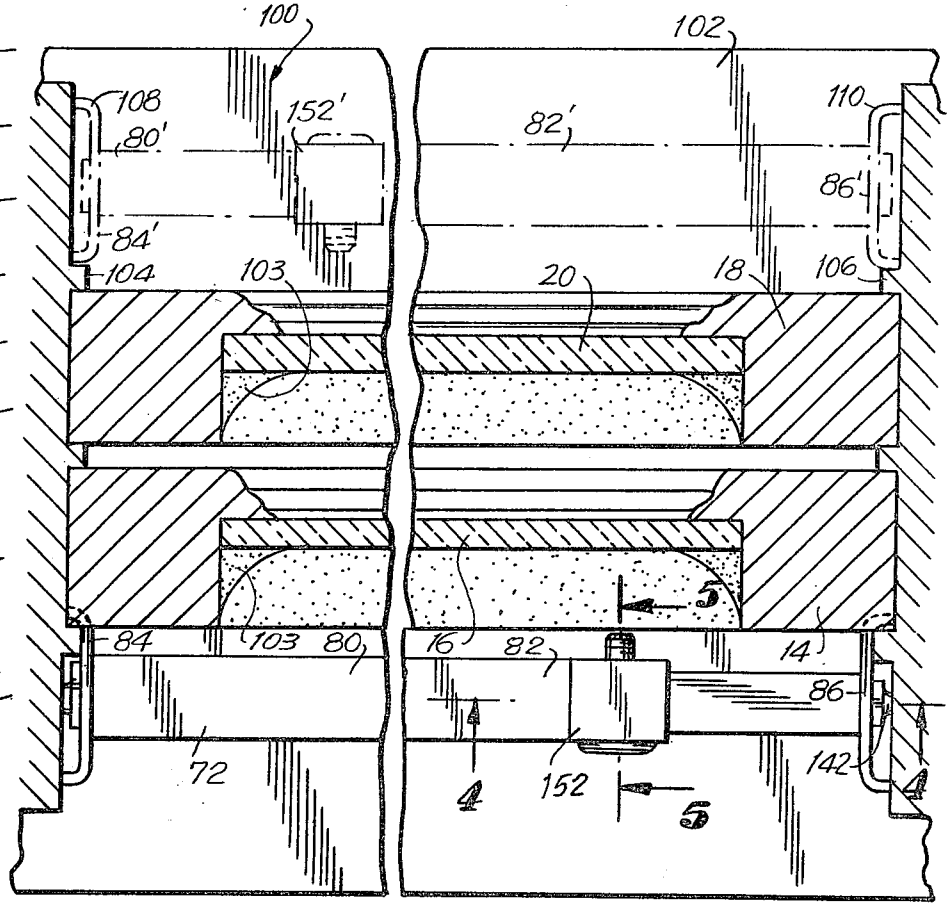
FIG. 3 illustrates in the lower portion of the figure the present invention taken along line 3—3 of FIG. 2. The invention as it would appear mounted on the inside of the window is shown in the upper portion in phantom illustration.

Reference is now made in more detail to the drawings. A brief description of the prior art childrens safety buted by Jaybil Industries Inc. shown in FIG. 1 will first be made in order to more clearly distinguish the improvements of thements of the present invention over the present state of the art.

Prior art childrens safety guard apparatus 10 in FIG. 1 is mounted on the outside of double hung window 12 with outer upper window sash 14 holding upper pane 16 and inner lower window sash 18 (shown in raised position) holding lower pane 20. Window frame 22 and outer sill 24 are also shown set into house wall 25. Three horizontal members 26, 28, and 30 are welded to side stile 32 (hidden behind frame 10) and middle stile 34 to form first unit 36. Second unit 38 comprises three horizontal members 40, 42, and 44 welded to side stile 46 and middle stile 48. First and second units 36 and 38 are slidingly joined to one another for purposes of adjustability to conform to different size windows. Specifically, first unit horizontal members 26, 28, 30 set through passages 50, 52, and 54 formed in middle stile 48; and second unit 38 is joined to first unit 36 via second unit horizontal members 40, 42, and 44 set through passages 56, 58, and 60 formed in middle stile 34. Thus, the horizontal members of the first unit slide in passages in the middle stile of the second unit; and the horizontal members of the second unit slide in passages in the middle stile of the first unit. At the time of installation of the apparatus in the window, the side stile of either the first or second unit may be screwed to the window frame, for example, at screws 62, and 64 of side stile 46 of second unit 38, and then the other unit, for example, first unit 36, is adjusted to the width of the window the stile set flush to the window frame and screwed to the frame. The side stiles are channel members and with the channel 66 set over the back track 68 of the upper outside window. This positioning is necessary to aid in protecting the screws of the apparatus from being levered for it limits levering and in addition would keep the stile in position to some extent even if the screws failed. For this reason, the prior art apparatus can only be mounted on the outside of the window.

Figure 2:
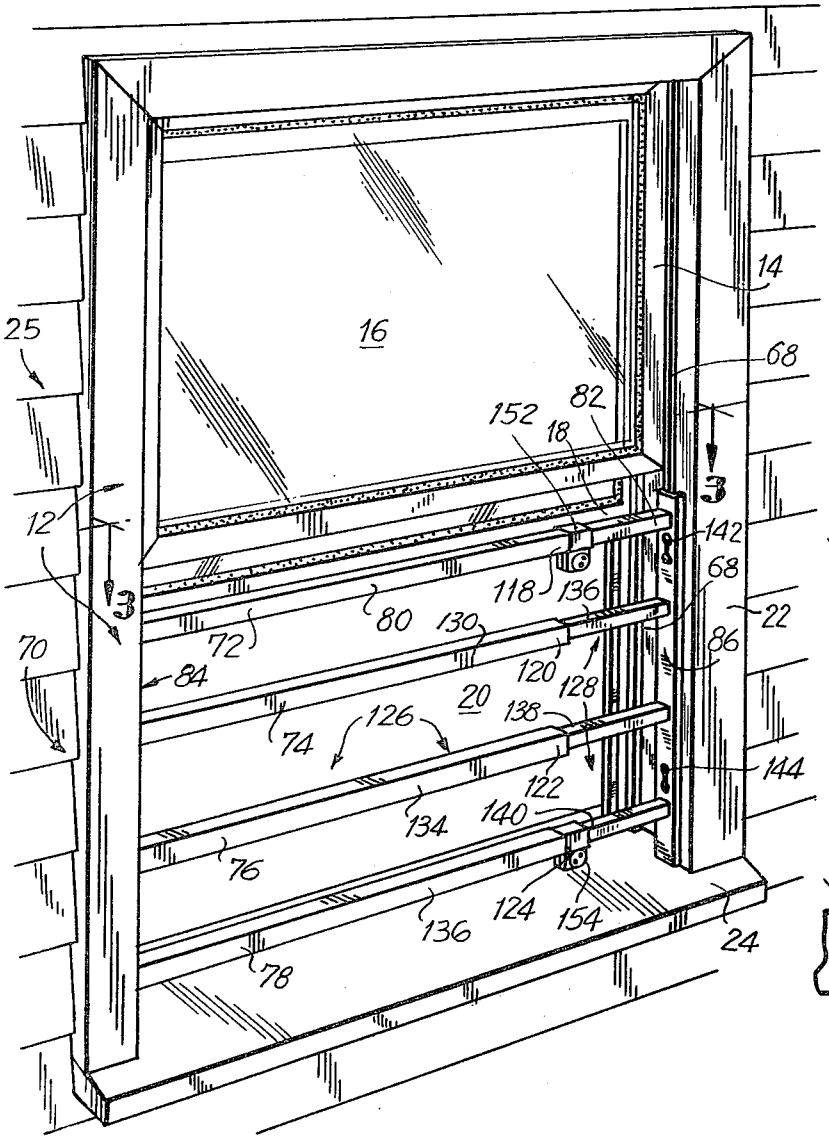
FIG. 2 illustrates the present invention in a perspective view of the safety guard mounted on the outside of a double hung window with the safety bars in a horizontal position.

FIG. 2 illustrates in a perspective view the childrens guard apparatus 70 according to one embodiment of the present invention. Apparatus 70 is, like prior art apparatus 10, mounted on the outside of double hung window 12 with outer upper sash 14, upper pane 16, inner lower sash 18, lower pane 20, window frame 22, outer sill 24, and upper window back track 68. FIG. 3 shows a top cross-sectional view taken along line 3—3 of FIG. 2, including window sill 102 and pane putty 103. Four continous horizontal bars, preferably square in cross-section, namely upper bar 72, upper middle bar 74, lower middle bar 76, and lower bar 78 are shown disposed in spaced, approximately parallel relationship. The bars are spaced sufficiently far apart so as to prevent a small child from passing between the bars. The four bars each include two horizontal elongated members as follows. Upper bar 72 includes first horizontal member 80 in sliding connection with second horizontal member 82 with first member 80 rigidly connected to first side support member 84 and member 82 rigidly connected to second side support member 86. Horizontal members 72, 74, 76 and 78 are provided with vertical flanges disposed through side support members 84 and 86 as portrayed in exemplary illustrations in the side view cross-section in FIG. 4 and an end view elevation in FIG. 6. In particular, vertical flanges 88 and 90 of horizontal member 82 are shown clasping side support element 86 inside of "U" channel 92 with horizontal member 82 passing through aperature 94. Thus first member 80 is rigidly connected to first side support element 84 (hidden in FIG. 2 by perspective and shown in FIG. 3) at first connecting end 96; and second member 82 is rigidly connected to second side support element 86 (shown in FIGS. 2 and 3) at second connecting end 98.

First and second side support elements 84, 86 are positioned in window frame 22 outside back track 68 (in contrast to the mouning of prior art apparatus 10 in FIG. 1, which is shown with stile "U" channel 66 positioned clasping back track 68). It is, of course, possible for side support elements 84, 86 of the present invention to straddle back track 68 as does prior art apparatus 10, but positioning adjacent to outside back track 68 is shown in order to emphasize the greater possibilites of the present invention. With regard to this range, FIG. 3 illustrates a practical application of this greater range of possibilites of my invention. Shown in phantom illustration at the top of FIG. 3 is my apparatus 100 as it would be portrayed if it were shown mounted in FIG. 2 inside the inner lower window sash 18, where no upper sash track passes. Here, inner sill 102 is shown and the frame supports 104, 106 adjoin the inner track (not shown) on which inner lower sash 18 rides. Phantom first support 108 and phantom second support 110 are shown positioned abutting frame supports 104, 106. Other related elements are noted in primes.

First elongated member 80 has receiving end 112 opposed to its connecting end 96, and second elongated member 82 has inserting end 114 opposed to its connecting end 98. First member 80 is preferably hollow, that is, forms a longitudinal or elongated, central internal chamber 15 opening at least by way of aperature 116 at receiving end 112. Second member 82 at insertable end 114 is sized so as to be capable of being inserted into aperature 116 in sliding mating relationship with first member 80. As shown in the embodiment, both elongated members 80 and 82 are rectangular, that is, square as particularly shown, in cross-sectional outer configuration. Member 82 does not have to be hollow, but for reasons of cost and weight, member 82 is preferably hollow as illustrated in FIGS. 4, 6, and 7. Members 80 and 82 are thus joinable and slidable back and forth, and upper bar 72 is thus adjustable to a predetermined length, and a first means for adjusting 118 is provided. The details of the above discussion are likewise fully applicable to the three remaining bars 74, 76, and 78, each having a first and second elongated member having a means for joining thus providing second, third and fourth means for adjusting 120, 122, and 124 respectively. The four bars are, of course, a preferred embodiment and the number of bars may vary according to use.

Apparatus 70 thus comprises two separate units, that is, a first unit 126 including the four first elongated members; namely, upper member 80, upper middle member 130, lower middle member 132, and lower member 134, each connected, in the manner described with reference to member 80 to first side support element 84; and a second unit 128 including the four second elongated members, namely, upper member 82, upper middle member 136, lower middle member 138, and lower member 140, each connected, in the manner described with reference to member 82, to second side support element 86.

In installation, the four first and second elongated members are slidingly mated to the four bars described, and apparatus 70 is placed into the area desired. Either first or second unit 126 or 128 is placed next to window frame 22 abutting (or straddling) back track 68 (or front track 104) with first or second side support elements 84 or 86 respectively hard against the frame. FIG. 2 shows second side support element 86, and, assuming that this was first placed into position, first unit 126 with first side support element 84 is slidingly adjusted to the full width of the window until it presses against the frame in an area opposing second support element 86, as indicated in FIG. 3.

At least two screws for each side support are provided as exemplified by upper screw 142 and lower screw 144 provided for second side support 86 in FIG. 3 and in profile in FIG. 4. The two screws are then screwed into the frame. The frame may be either wood or metal and different techniques and equipment would be necessary for each. Screw holes are provided in support element 86 exemplified by upper screw hole 143.

FIG. 6 illustrates an end view of a preferred embodiment of upper screw aperature 146 for upper screw 142 for affixing second side member to frame 22. Aperature 146 includes overlapping upper screw-mounting slot, or hole, 148 and lower screw-releasing slot, or hole, 150, comprising a preferred means for connecting elements 84 and 86 to the window frame when the bars of the apparatus are horizontal. (When the bars are vertical, flanges with screw holes may be necessary.) A plurality of aperatures 146 match a plurality of screws, exemplified by screw 142 having screw head 143 secured to frame 22. Aperature 146 comprises, then, overlapping first and second screw holes 148 and 150 respectively. First hole 148 is smaller than screw head 143 and second screw hole 150 is larger than the screw head. Second hole 150 is positioned over hole 148. Thus, apparatus 70 can easily be mounted to existing screws by sliding the support elements over the screws via the lower second screw hole and then dropping the apparatus so that the screw slides into the upper first hole. Removal of the apparatus from the window is accomplished by reversing the process described, namely, by lifting the apparatus so that the screw head is sligned with the lower screw hole. Unlocking of the means for locking is necessary, and once accomplished, the first and second members are slid together, thus shortening the bars, and the first and second elements are pulled away from the support screws via the lower holes, exemplified by lower hole 150.

Two bar locks, upper lock 152 and lower lock 154, are illustrated in FIG. 2. Each lock is mounted to a second elongated member, specifically upper second member 82 and lower second member 140. Although one, three, or four locks could be mounted, two locks, one secured to the upper and lower member as shown, is preferred. Upper lock 152 will be taken as the example for other locks, which are identical in detail as lock 152. Lock 152 is shown in detail in FIGS. 2, 3, 4, and particularly in FIG. 5. As illustrated, lock 152 is mounted on second member 82 abutting on upper first member 80 for a reason set forth below. FIG. 5 shows lock 152 in detail as including flexible sleeve portion 156, which is slidably mounted around second member 82. It is to be noted that the outer cross-sectional configuration of the first and second members, that is, the bars, is preferably rectangular rather than circular in configuration. In fact, the outer-cross-sectional configuration of the bars can be circular, triangular, or irregular. In practice, however, sleeve 156 has superior gripping strength when the bar is rectangular and inner cavity 158 and outer surface 160 of the sleeve are rectangular in cross-section. This rectangular configuration has the advantage of providing an added safety feature, for it is apparent that a child would have more difficulty passing between rectangular bar than cylindrical bars. Lock 152 also includes grip 162 also rectangular in configuration that is mounted in surrounding contact with flexible sleeve 156. The grip has longitudinal slot 164 and opposed flanges 166 and 168 extending from the grip on either side of slot 164. Flanges 166 and 168 form opposed bolt holes 170 and 172 capable of receiving the threaded shaft 174 of bolt 176, which also includes bolt head 178. Nut 180 is positioned in nut-gripping pocket, or cavity, 182, which is capable of preventing the nut from turning in the cavity. Bolt 176 also has bolt head 184, which is provided with keyway 186. When key 188, which matches keyway 186, is inserted into the keyway and turned in a tightening direction, via handle 189, bolt 176 is threaded to nut 180 and flanges 166, 168 are drawn together and grip 162 tightens around sleeve 156 until lock 152 becomes locked to second member 82 and relatively immovable. When the key is turned in the opposite direction, grip 162 is loosened and lock 152 is released.

In summary, the means for locking includes a flexible sleeve portion mounted a second elongated member (as selected) and positioned so as to abut shoulder 190. The flexible grip is mounted around the sleeve portion, the grip having the same configuration as the bar, preferably, as shown, square in cross-section. The grip has a longitudinal slot and two opposed flanges extending from the grip on either side of the slot, the flanges forming opposed bolt holes. One of the flanges forms a nut gripping cavity around its bolt hole. A nut capable of being held immobile in the cavity is positioned in the cavity, and a bolt having a threaded shaft is positioned the bolt holes is threaded to the nut. The bolt has a head forming a keyway capable of receiving a key. The shaft of the bolt is positioned through the bolt holes, the head positioned outside the flange opposite the flange holding the nut. Thus, when a key matching the keyway is inserted into the keyway and is turned in a bolt-tightening direction, the flanges of the grip are drawn together and the grip pressures the sleeve portion into pressured immobile relationship with the second elongated member, and when the key is turned in the opposite direction, the sleeve portion is released.

The strengthening of device 70 by means of the locks as exemplified by lock 152 just described is exemplified as follows. Typical first elongated member 80 has a first cross-sectional area and typical second elongated member 82 has a second cross-sectional area. These areas are indicated in FIG. 5 through inside dimension $D_1$ of square member 80 and outside dimension $D_2$ of square member 82. $D_1$ is greater than $D_2$, since member 82 is slidingly matable into member 80. This mating relationship comprises first means for adjusting 118 described previously. The resulting difference in cross-sectional areas creates shoulder 190 (see FIG. 4), abutting which is lock 152. Thus, the bar is resistent to compression, or shortening, of the length as predetermined by the width of the window. It is noted that, although lock 152 does not prevent lengthening of the bar, that length is already maintained by the window frame. In addition, the abutment of lock 152 against shoulder 190 does inhibit the leverage of the fastening screws, for any radial pressure, that is, pressure lateral to the length of the bar, is met by a counter pressure of the lock and the shoulder meeting. Since the lock, via the sleeve portion and the grip, mates the bar in configuration, the inhibition counter pressure would be created approximately equally around the periphery of the lock and the shoulder, since the second elongated member is inserted at the center of the first elongated member. The inhibition of levering action against the screws, therefore, is in addition with the prevention of the shortening of the length of the bars, discussed below. In addition, it should be noted that the remaining bars remain locked in position by the action of one lock, although, as illustrated, two locks on two bars is preferred. Finally, apparatus 70 cannot be removed from the window frame unless the lock or locks are unlocked.

The lock described in conjunction with the shoulder described creates other possibilities for apparatus 70. Because of the compressive resistence given to the bars, they may be employed successfully not only horizontally inside or outside windows without having to straddle the window track but also vertically, as illustrated in FIGS. 8, 9, 10, and 11.

Figure 11:
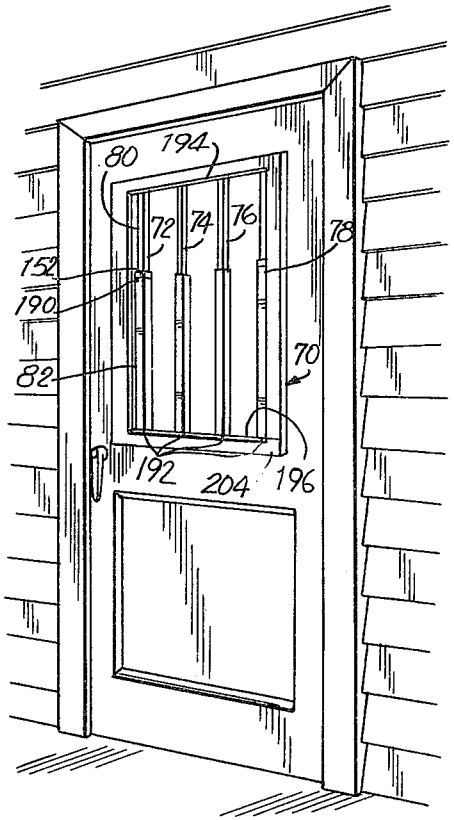
FIG. 11 shows the present invention with vertically positioned bars in the window of a door.
Figure 9:
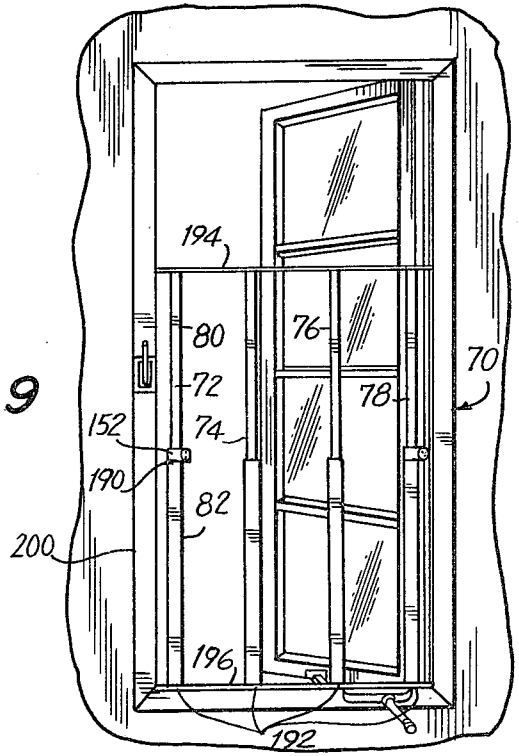
FIG. 9 shows the present invention as it appears with the bars in a vertical position in a casement window.
Figure 8:
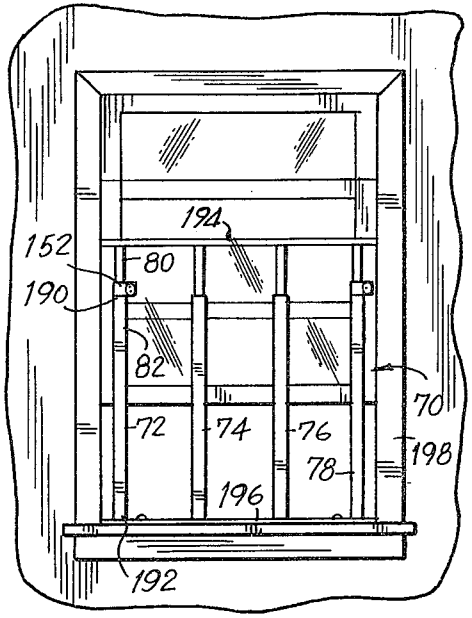
FIG. 8 illustrates the present invention mounted in a double hung window with the bars in a vertical position.
Figure 10:
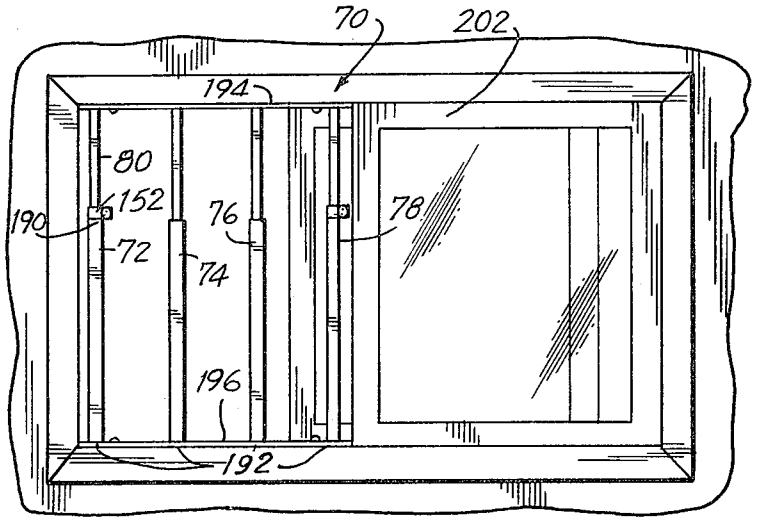
FIG. 10 illustrates the present invention mounted with vertically standing bars in a side-sliding window.

FIG. 8 illustrates apparatus 70 fitted with bars 72, 74, 76, and 78 mounted vertically outside a double hung window 198. FIG. 9 illustrates apparatus 70 with vertical bars mounted inside a casement window 200. FIG. 10 illustrates apparatus 70 mounted with vertical bars in side sliding window 202. Also, apparatus 70 is shown in FIG. 11 with the bars hung vertically in door window 204. In each of these illustrations, top horizontal support member 194 and bottom support member 196 are situated at the top and bottom of the apparatus. It is noted that the larger first members, exemplified by first elongated member 80, are located at the bottom of the apparatus and the smaller elongated members, typified by second member 82, are located at the top. Thus, shoulder 190 faces upward, and the locks, typified by lock 152, press downward on the shoulder. Thus, the weight of second unit 128 is absorbed at the shoulder and mostly passed on to the bases of the bars, typified by bar 192 of the bars. Upper support member 194 is equipped with side securing flanges or other attachment devices (not shown) known in art for securing the apparatus on the top side.

In the illustrations, the bars are shown as disposed in approximately parallel relationship and the support members also are approximately parallel, the support members and the bars being approximately in perpendicular planes. This is the general and usual configuration for these elements of apparatus 70. It is possible, however, for the apparatus to be applicable for frames of non-rectangular configuration as it is for the bars to be disposed in other than parallel relationship.

The material employed is generally and usually a lightweight, strong metal, but any rigid, strong material can be used, such as many of the polymer plastic substances known to the art, for example.

The embodiment of the invention particularly disclosed and described here is presented merely as an example of the invention. Other embodiments, forms, and modifications of the invention coming within the scope and spirit of the appended claims will, of course, readily suggest themeselves to those skilled in the art.

What is claimed is:

1. A safety guard apparatus for installation into the frame of a window or the like, comprising:

first and second support elements, said elements having means for connecting said elements to said frame, a plurality of bars having opposed ends, said ends being secured to said first and second support elements, said bars being disposed in spaced relationship and having means for adjusting said bars to a predetermined length, and means for locking said bars to said predetermined length and preventing said length from being shortened, said means for unlocking including a means for unlocking, said means for locking being positioned on at least one of said bars, whereby said means for locking maintains said plurality of bars at said predetermined length thus aiding in maintaining the integrity of the means for connecting said first and second support elements to said frame, said plurality of bars including a first elongated member having one end secured to said first support element and having a receiving end, said first support element having an elongated central chamber open at said receiving end, a second elongated member having one end joined to said second support element and having an opposed insertable end capable of being inserted into said chamber at said receiving end of said first member in sliding mating relationship, said second member being capable of being withdrawn from said first member, whereby each of said bars may be adjusted to said predetermined length, said first elongated member having a first cross-sectional area and said second elongated member having a second cross-sectional area, said first area being larger than said second area, said first member forming a shoulder with said first member at said receiving end, and wherein said means for locking is mounted to said second member and positioned abutting said shoulder, whereby said shoulder absorbs longitudinal pressure from said second member and said second member is prevented from passing farther into said chamber, and wherein said means for locking includes a flexible sleeve portion mounted to said second member and positioned so as to abut said shoulder, a flexible grip mounted around said sleeve portion, said grip having a longitudinal slot and two opposed flanges extending from said grip on either side of said slot, said flanges forming opposed bolt holes, one of said flanges forming a nut-gripping cavity around the bolt hole of said first flange, a nut capable of being held immobile in said cavity being positioned in said cavity, and a bolt having a threaded shaft, said shaft being positioned in said bolt holes and threaded to said nut, said bolt having a bolt head forming a keyway capable of receiving a key, said shaft being positioned in said bolt holes with said head positioned outside the flange opposite the flange holding said nut, whereby when a key matching the keyway is inserted into the keyway and is turned in a bolt-tightening direction, the flanges of the grip are drawn together and the grip pressures the sleeve portion into pressured immobile relationship with said second member, and when the key is turned in an opposite direction, the sleeve portion is released.

* * * * *